US005741147A

United States Patent [19]

Konoya et al.

[11] Patent Number: 5,741,147

[45] Date of Patent: Apr. 21, 1998

[54] JOINT CONNECTOR

[75] Inventors: Hisashi Konoya; Hitoshi Okumura, both of Yokkaichi, Japan

[73] Assignee: Sumitomo Wiring Systems, Ltd., Japan

[21] Appl. No.: 584,972

[22] Filed: Jan. 11, 1996

[30] Foreign Application Priority Data

Jan. 10, 1995 [JP] Japan ..... 7-018596

[51] Int. Cl.[6] ..... H01R 29/00

[52] U.S. Cl. ..... 439/189; 439/459; 439/527

[58] Field of Search ..... 439/92, 95, 189, 439/450, 527, 574, 575, 752; 174/74 R, 78

[56] References Cited

U.S. PATENT DOCUMENTS 4,456,317 6/1984 McCleerey ..... 439/101
5,356,302 10/1994 Inoue et al. ..... 439/189

FOREIGN PATENT DOCUMENTS 0 584 582 3/1994 European Pat. Off. .
0 605 200 7/1994 European Pat. Off. .
61-190688 11/1986 Japan .

*Primary Examiner*—Neil Abrams
*Assistant Examiner*—Barry Matthew L. Standig
*Attorney, Agent, or Firm*—Banner & Witcoff, Ltd.

[57] ABSTRACT

An electrical connector comprises a housing, a plurality of terminals mounted within the housing, and a connector plate for electrically connecting the terminals. The connector plate comprises a support member and an elongate plate-like member projecting from the support member. The housing is formed with an elongate slit for receiving the plate-like member, and with connection member for detachable engagement with complementary connection member formed on the support member. The arrangement is such that, when the connection member of the support member and the housing are engaged to fix the connector plate to the housing, the plate-like member extends into the slit and into electrical contact with each of the terminals.

12 Claims, 9 Drawing Sheets

JOINT CONNECTOR

BACKGROUND OF THE INVENTION

This invention relates to an electrical connector, and in particular to a connector suitable for making an earth connection.

A conventional electrical connector is shown in FIG. 16, this connector being described in greater detail in official Gazette Number Jikkaisho 61-190688. The connector has a thin box-shaped housing 1 formed with partitioning walls 1*a* which define terminal insertion chambers 1*b*. Each of the terminal insertion chambers 1*b* is open at both ends, and is tubular in shape. The terminal insertion chambers 1*b* are mutually parallel, and each is designed to accommodate a terminal 2. Each terminal 2 has an electric wire 3 connected at one end by means of crimping, and has an insertion member 2*a* formed at the other end. The insertion member 2*a* of each terminal 2 is insertable into a complementary terminal (not shown) so as to form a male-female connection.

A connector plate 4 is associated with one open end of the housing 1, the connector plate made from metal and extending along the entire width of The housing. The connector plate 4 is formed with blade-shaped terminals members 4*a* in a comb-like arrangement. The terminal members 4*a* are insertable into the terminal insertion chambers 1*b*, to fit against the insertion members 2*a* of the terminals 2. At the end opposite to that from which the terminal members 4*a* extend, the connector plate 4 is formed with a generally V-shaped tab. This tab is formed with a through-hole 4*b* through which a bolt can be passed for fixing the connector plate 4 to an earthed member.

When the connector plane 4 is inserted into one of the open ends of the housing 1, the terminal members 4*a* enter the terminal insertion chambers 1*b*. Then, when the terminals 2, with the electric wires 3 crimped thereto, are inserted into the other open end of the housing 1, the insertion members 2*a* and the terminal members 4*a* fit against each other. A bolt is then inserted into the through-hole 4*b* of the connector plate 4 to fix the connector plate 4 to a metal case, thereby earthing the wires 3.

One disadvantage of the type of connector is that a special connector plate 4 has to be provided for each housing 1, since each of its terminal members 4*a* must be inserted into a corresponding terminal insertion chamber 1*b*, and the terminal members and the terminal insertion chambers must be in a one-to-one relationship.

Another disadvantage of the prior are connector is that the direction of disconnection from the plate 4 is the same as the insertion direction of the terminals. Thus here is a tendency for the wires 3 rather than the housing 1 to be grasped for disconnection, which may result in damage to the connector.

Yet another disadvantage is that the plate 4 must have male terminals of the same size as the corresponding female terminals of the connector. This means that a change in the size of adjacent female terminals necessarily require a new plate 4.

The prior art device offers two possibilities of disconnection, either via the mounting aperture 4*b* or by physically separation of the housing 1 and the plate 4. The first method avoids disturbing the connection between the male and female terminals and may be preferred—the second method however is more likely to be used, and may result in poor connection after many disconnections and re-connections.

The aim of the invention is to provide an improved form of connector.

SUMMARY OF THE INVENTION

The present invention provides an electrical connector comprising a housing, a plurality of terminals mounted within the housing, and a connector plate for electrically connecting the terminals, the connector plate comprising a support member and an elongate plate-like member projecting from the support member, the housing being formed with an elongate slit for receiving the plate-like member, and with connection means for detachable engagement with complementary connection means formed on the support member, the arrangement being such that, when the connection means of the support member and the housing are engaged to fix the connector plate to the housing, the plate-like member extends into the slit and into electrical contact with each of the terminals.

Advantageously, the housing is formed with a plurality of parallel chambers, each of which receives a respective one of the terminals, and the slit extends across the housing substantially at right-angles to the axes of the chambers. As the slit extends right across the housing, the plate-like member can be electrically connected to the terminals even when the width of the connector plate is greater than that of the housing, since the continuous plate-like member can be inserted into the slit to engage the terminals even if parts of the member extend transversely beyond the sides of the housing. In other words, if a relatively wide connector plate is provided, it is possible to attach housings of different sizes. The connector of the invention is, therefore, more versatile and has greater interchangeability than known connectors.

Preferably, each Terminal includes a terminal insertion member which is received in a respective one of the chambers. Conveniently, each of the terminal insertion members is configured to receive the free edge portion of the plate-like member. Thus, each of the terminal insertion members may be formed with a slot for receiving the free edge portion of the plate-like member. Preferably, the slots in the insertion members are sized to receive the free edge portion of the plate-like member as a friction fit. Alternatively, each of the terminal insertion members may be formed with a bent over portion which is sized and shaped to receive the free edge portion of the plate-like member.

In a preferred embodiment, the connector plate is provided with a connection member for connecting the connector plate to an earthed conductor, the connection member extending from the support member at an edge opposed to that from which the plate-like member projects.

Advantageously, the plate-like member extends substantially at right-angles to the support member.

The invention also provides an electrical connector comprising two housings, each of which is provided with a plurality of terminals mounted therein, and a connector plate for electrically connecting the terminals of both the housings, the connector plate comprising support member means, and elongate plate-like member means projecting from the support member means, each of the housings being formed with an elongate slit for receiving the plate-like member means, and with connection means for detachable engagement with complementary connection means formed on the support member means, the arrangement being such that, when the connection means of the support member means and the housings are engaged no fix the connector plate to the housings, the plate-like member means extends into the slits and into electrical contact with each of the terminals.

In a preferred embodiment, a single support member constitutes the support member means and a single plate-like member constitutes the plate-like member means, and the arrangement is such thee the two housings can be fixed side-by-side to the connector plate.

Alternatively, the support member means is constituted by a pair of parallel support members, each of which is formed with an elongate plate-like member projecting therefrom, the elongate plate-like members constituting the plate-like member means and projecting from their support members substantially at right-angles in opposite directions, whereby the two housings can be fixed face-to-face to the two support members. This permits two housings to be attached to the connector plate even if there is insufficient space width-wise to receive two housings side-by-side.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
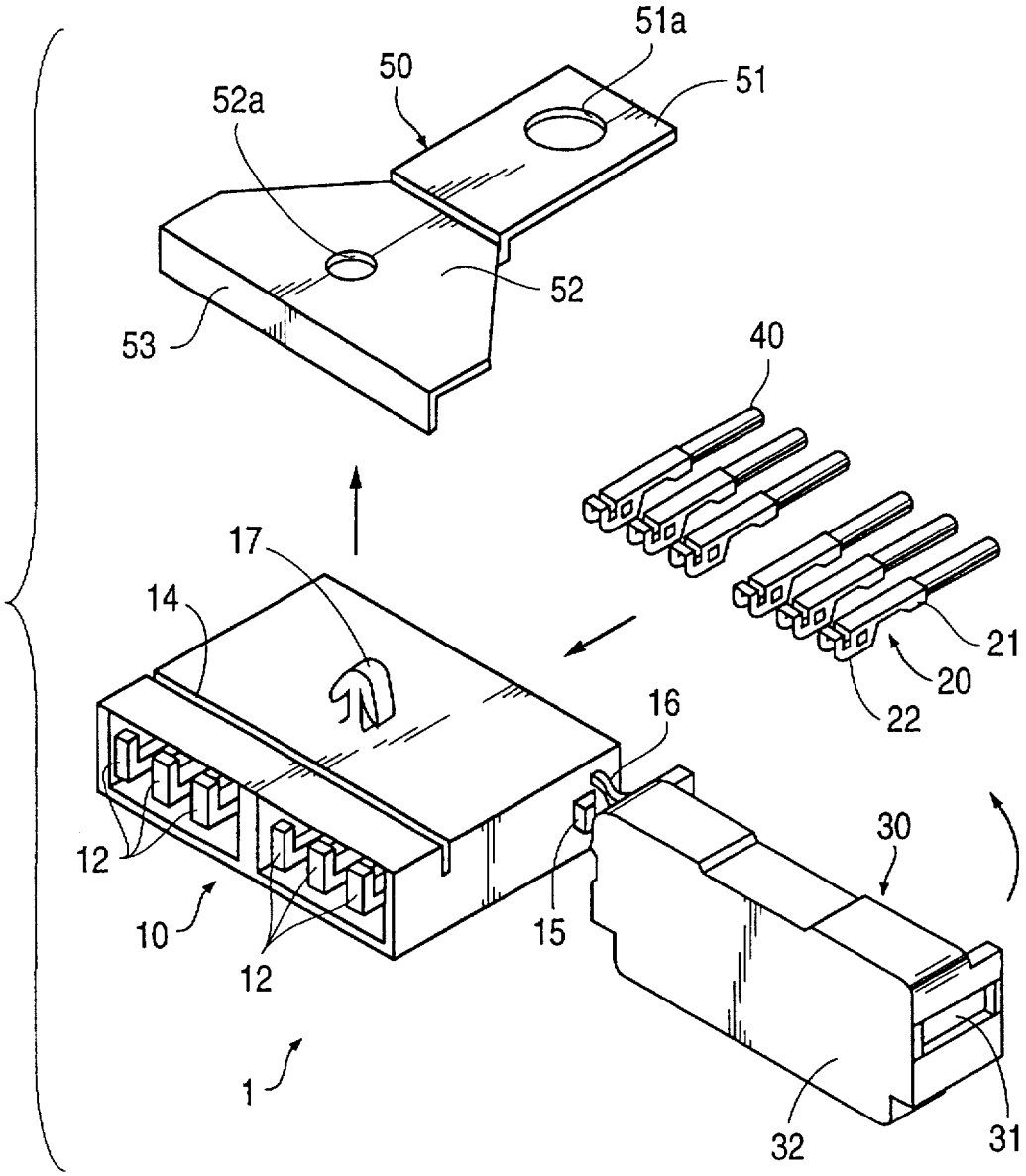
FIG. 1 is an exploded perspective view, from above, of a first form of connector constructed in accordance with the invention.
Figure 2:
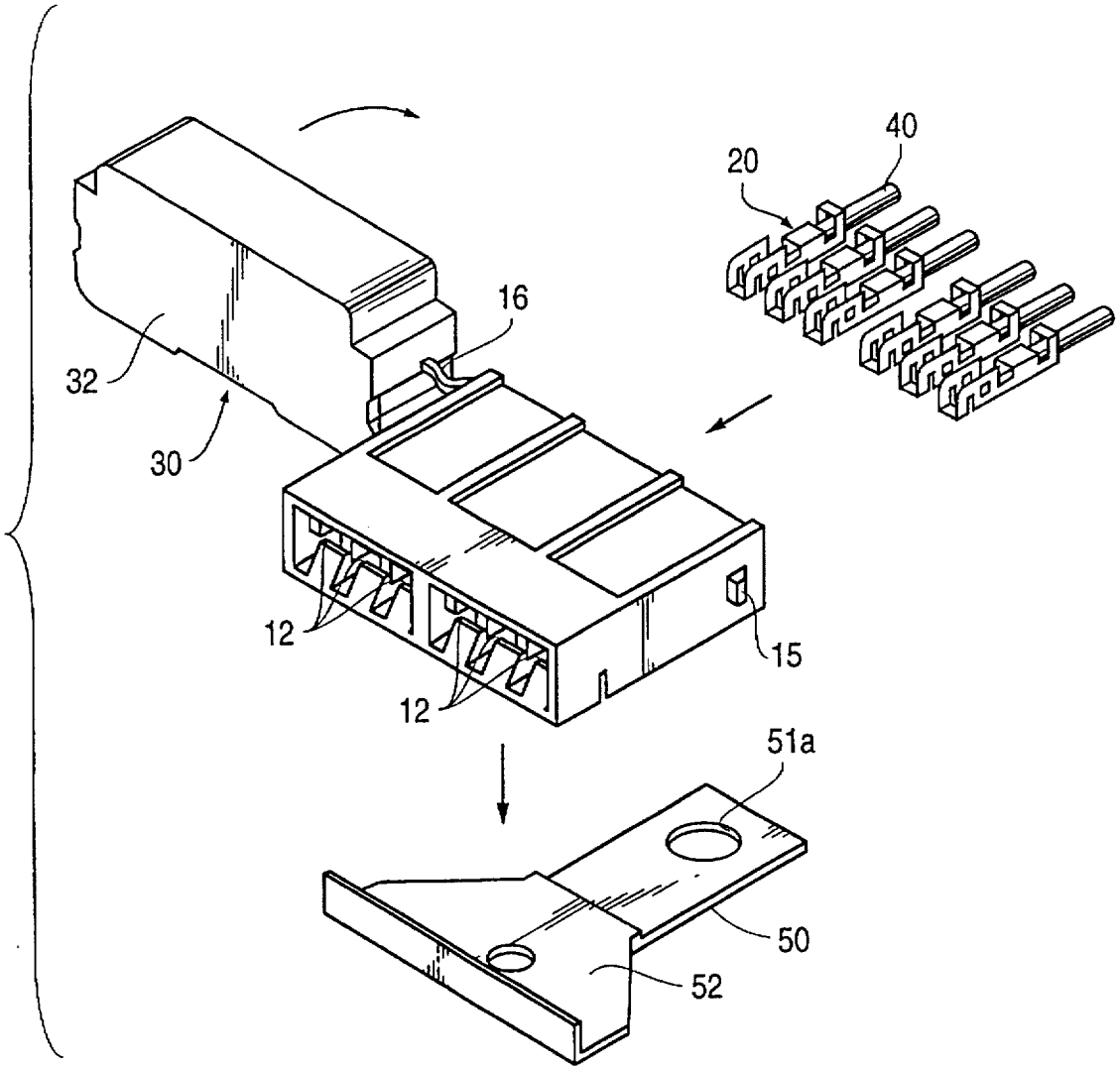
FIG. 2 is an exploded perspective view, from below, of the first form of connector.

Referring to the drawings, FIG. 1 shows a connector 1 having a thin box-shaped housing 10 formed with six terminal insertion chambers 12. Six terminals 20 are insertable into the terminal insertion chambers 12. Each terminal 20 has an electric wire 40 connected at one end, and has an insertion member 22 formed at the other end. Hereafter, the lower left end of the connector of FIG. 1 will be referred to as the front end.

A connector plate 50, which is made from a flat sheet of metal, is associated with the housing 10. The connector plate 50 is shaped so as to be narrower towards its rear end, and so as to extend to form a bracket 51. The bracket 51 has a bole hole 51*a* formed therein for bolting to, for example, an automobile body. A base plate 52 is connected to the bracket 51 and widens in the direction opposite to the end where the bracket 51 is located. A through-hole 52*a* is formed in the base plate 52. The through-hole 52*a* constitutes means for fitting and supporting the connector plate 50 to the housing 10. The width of the front end of the base plate 52 is greater than the width of the housing 10, and the front end is downwardly bent through approximately 90° along its entire width to form a terminal member 53.

Instead of the base place 52 being of trapezoidal shape, so that the bracket 51 is formed on the narrow rear end of the base plate and the terminal member 53 is formed on the wide front end thereof, the bracket 51 may be formed by bending the front end of a rectangular plate through approximately 90° so that the bracket has the same width as the terminal member 53.

Figure 4:
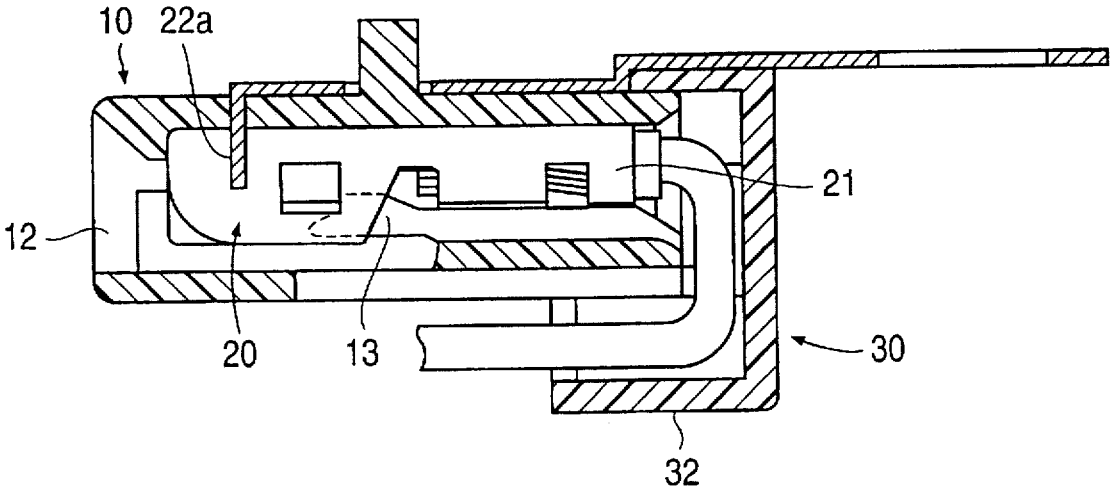
FIG. 4 is a cross-sectional view showing the first form of connector in the assembled state.

The six terminal insertion chambers 12 of the housing 10 are provided in two sets of three parallel chambers. As shown in FIG. 4, a resilient lance 13 is formed on the base of each of the terminal insertion chambers 12. Each lance 13 is arranged to fit against the associated terminal 20 thereby to support it. A slit 14 (see FIG. 1) is formed in the upper surface of the housing, the slit lying parallel to the direction of alignment of the terminal insertion chambers 12, and extending over the entire width of the housing. The slit 14 is sized to receive the terminal member 53 of the connector plate 50, and the terminal member is sized so that its free edge enters the interior of each of the terminal insertion chambers 12. A clamp 17 is provided on the upper surface of the housing 10, the clamp mating, in use, with the hole 52*a* of the connector plate 50. When the clamp 17 fits within the hole 52*a*, the terminal member 53 can enter the slit 14 of the housing 10. This position will be referred to as the specified position.

The hole 52*a* is shaped to conform with the configuration of the clamp 17, and it could have different shapes to conform with differently configured clamps. The degree of freedom of design of the housing 10 can be increased if the clamp 17 projects from The housing for engagement with the hole 52*a* in the base plate 52 (rather than projecting from the base plate for engagement with a hole in the housing). Moreover, the connector plate 50 need not be a simple flat plate, but can be provided with strengthening ribs. It would also be possible for the bracket 51 to have different shapes.

Although six terminal insertion chambers 12 are provided, by dividing the interior of the housing 10 into two sets of three parallel chambers, as long as the terminal member 53 enters the slit 14 in the specified position, the number of terminal insertion chambers 12 can be increased or decreased as necessary. If the short terminal member 53 is a linear member, the slit 14 is also linear. If, however, the terminal member 53 is formed as a curvilinear member, the slit 14 is also curvilinear.

Figure 3:
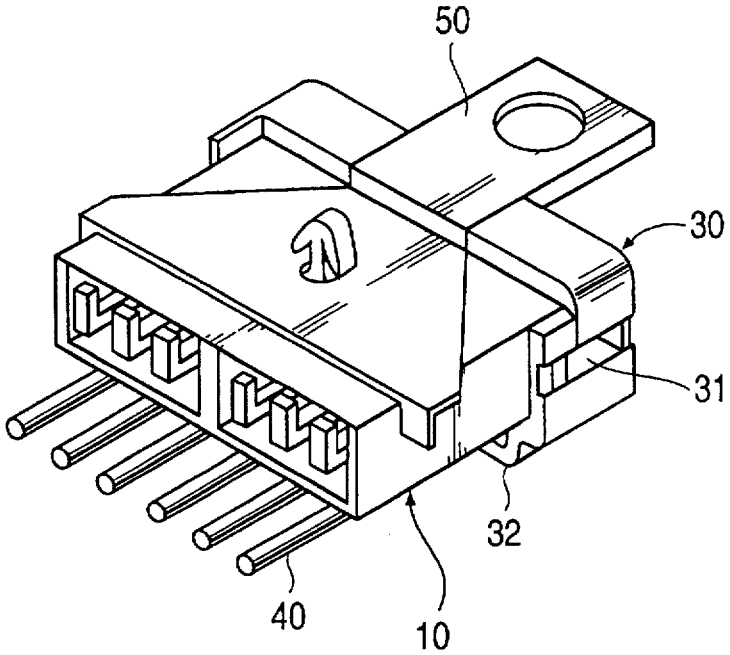
FIG. 3 is a perspective view showing the first form of connector in the assembled state.

Each side surface of the housing 10 is provided with a projection 15 formed at the rear end Thereof. The rear end of one of the side surfaces of the housing 10 is provided with a hinge 16 which is connected to a cap 30. The cap 30 is arranged to swivel, the hinge 16 as the axis, so as to cover the rear end of the housing 10. An aperture 31 is provided on a side surface of the cap 30 so that, when the cap covers the rear end of the housing 10, the aperture 31 mates with the projection 15. Moreover, as shown in FIG. 3, the base of the sap 30 is formed with a downwardly-projecting portion 32 which, when the cap covers the rear end of the housing 10, leaves a space to allow the electric wires 40 connected to the terminals 20 to bend around the rear edge of the housing and then along the lower surface of the housing box.

Each terminal 20 has a barrel member 21 formed at one end to allow crimping of the associated electric wire 40. Each terminal 20 also has a slit 22*a* formed at a location that faces the slit 14 when the terminal is inserted into its terminal insertion chamber 12. The width of each slit 22*a* is slightly less than the thickness of the terminal member 53, so that the terminal member is a tight friction fit therein. Instead of providing the terminals 20 with slits 22*a*, the front end of each terminal may be formed with a bent portion that faces the slit 14, thereby allowing the terminal member 53 to make contact with that terminal by fitting into its bent portion from the rear end thereof when the terminal member is inserted into the slit 14. In this way, the insertion members 22 can have different forms.

In use, the electric wires 40 are crimped onto the terminals 20, and the terminals are inserted into the terminal insertion chambers 12, from the rear end of the housing 10, with the slits 22*a* facing upwards. Each terminal 20 fits with, and is supported by, the respective lance 13 located in the housing 10, and its slit 22*a* is aligned with the slit 14 of the housing.

The housing 10 and the connector plate 50 are then fitted together firmly by inserting the clamp 17 into the hole 52*a*, so that the terminal member 53 enters the terminal insertion chambers 12 via the slit 14. Here, since the width of the terminal member 53 is greater than the width of the housing 10, the terminal member extends transversely beyond the side of surfaces of the housing.

When the terminal member 53 is inserted into the terminal insertion chambers 12 via the slit 14, the terminal member enters the slits 22*a* of the terminals 20 thereby making electrical contact with the terminals. In other words, the terminal 20 inserted into each terminal insertion chamber 12 makes contact with the connector plate 50 via the terminal member 53, thereby connecting the electric wires 40 associated with the terminals.

After this, since the electric wires 40 project from the rear end of the housing 10, they are collected together and bent along the lower surface of the back of the housing 10. Then, the cap 30 is swivelled about the hinge 16 so that it covers the rear end of the housing 10. The electric wires 40 pass through The downwardly-projecting portion 32 of the cap 30. The aperture 31 in the cap 30 mates with the projection 15 on the side surface of the housing 10, thereby fixing the cap 30 to the housing.

As clearly shown in FIG. 3, the disconnection direction is at right angles to the exit direction of the wires 40; here is consequently less risk of damage should the housing 10 be removed from the plate 50.

Furthermore it may be arranged for the clamp 17 to be adjacent a body panel of the vehicle, thus ensuring that disconnection is via the clamping bolt rather than by separation of the housing 10 and plate 50.

Figure 5:
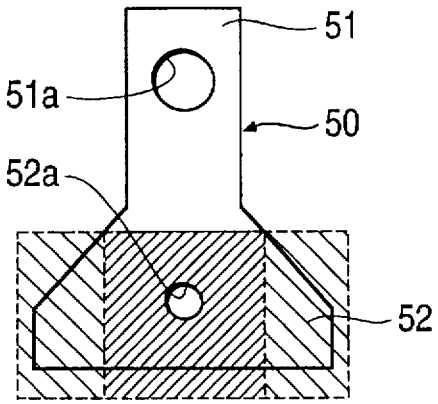
FIG. 5 is a schematic plan view showing a modification of the first form of connector.

Although the connector plate 50 of this form of connector is only slightly wider than the housing 10, it can be used with housings whose width is significantly less than that of the terminal member 53. Thus, FIG. 5 shows how housings of varying sizes can be fixed with respect to the same connector plate 50. For example, although it is not impossible to provide a plurality of tabs on the front end of a connector plate, with each tab corresponding to the width of a terminal insertion chamber of the housing, and there being more tabs than terminal insertion chambers, the same connector plate 50 of the invention can be used even when the width or spacing of the terminal insertion chambers 12 varies. Accordingly, the connector plate 50 is general-purpose item, since it can be attached to housings of different widths.

Figure 6:
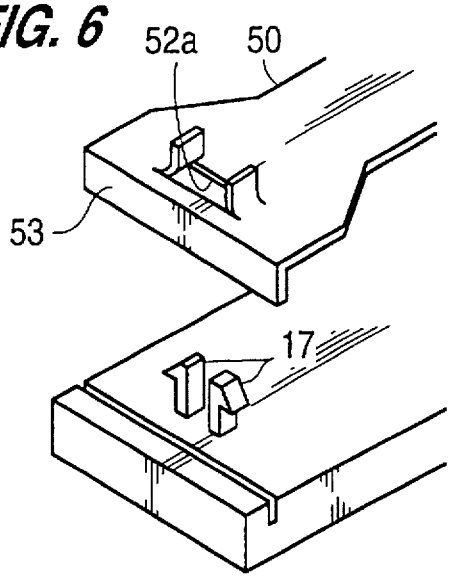
FIG. 6 is a perspective view showing another modification of the first form of the connector.
Figure 7:
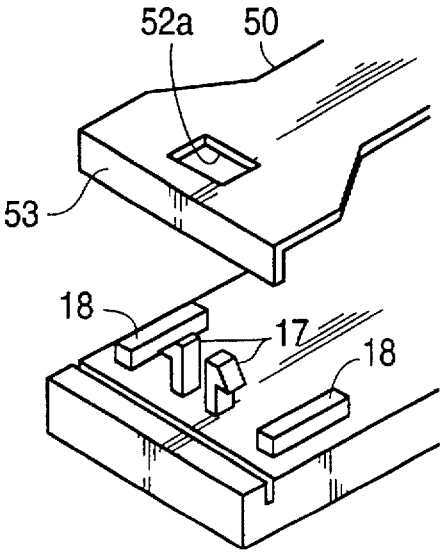
FIG. 7 is a perspective view showing another modification of the first form of connector.
Figure 8:
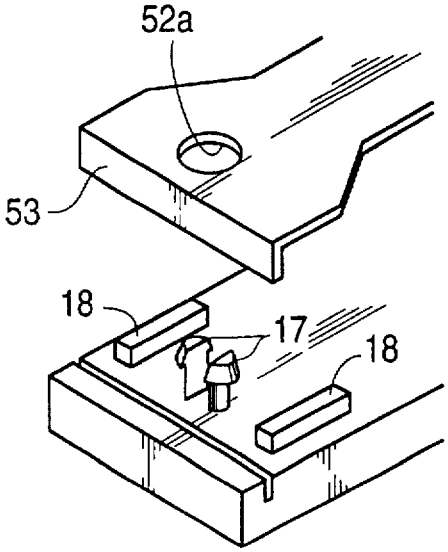
FIG. 8 is a perspective view showing another modification of the first form of connector.

FIGS. 6 to 8 show modifications of the connector of FIGS. 1 to 5. The details of the connector apertures are omitted to improve clarity of the respective drawings. Thus, FIG. 6 shows a modified form of clamp 17 and a corresponding modified form of hole 52*a*. As shown in FIGS. 7 and 8, the connector plate 50 rests on, and is supported by, steps 18 provided on the upper surface of the housing 10, thereby maintaining the resilience of the clamp 17.

Figure 9:
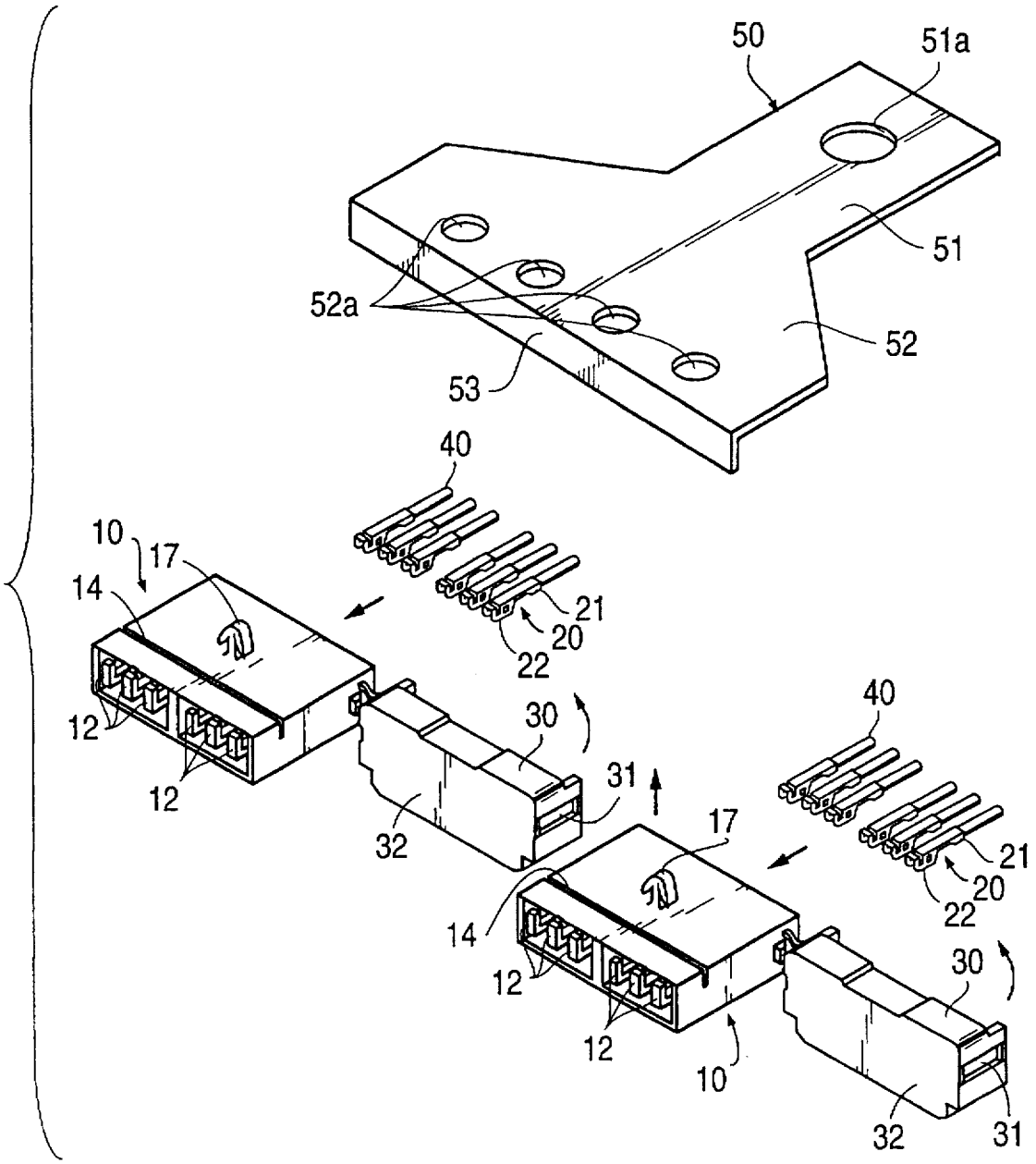
FIG. 9 is an exploded perspective view, from above, of a second form of connector constructed in accordance with the invention.
Figure 10:
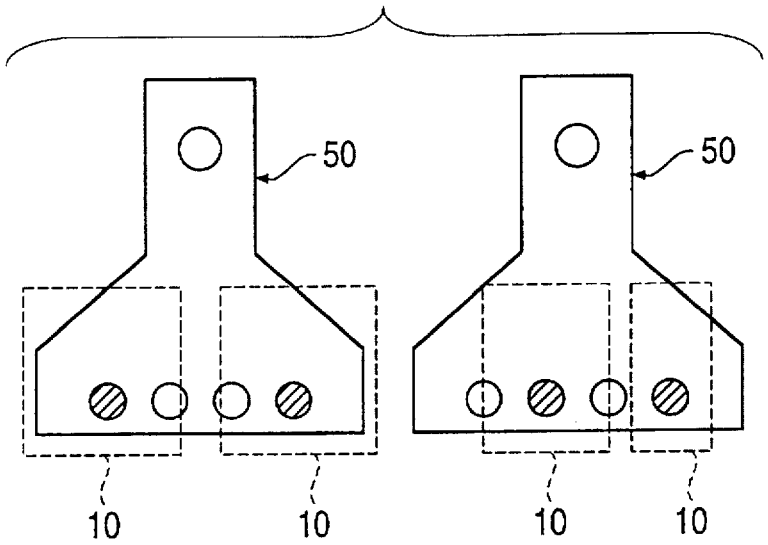
FIG. 10 is a schematic plan view showing a modification of the second form of connector.

FIG. 9 shows a second form of connection whose connector plate 50 is sized so that its terminal member 53 is wide enough to permit the connection of two housings 10. In this case, four holes 52*a* are formed in the base plate 52 of the connector plate 50. As shown in FIG. 10, this permits the attachment of two housings 10 having the same dimensions, or two housings having slightly different dimensions.

Figure 11:
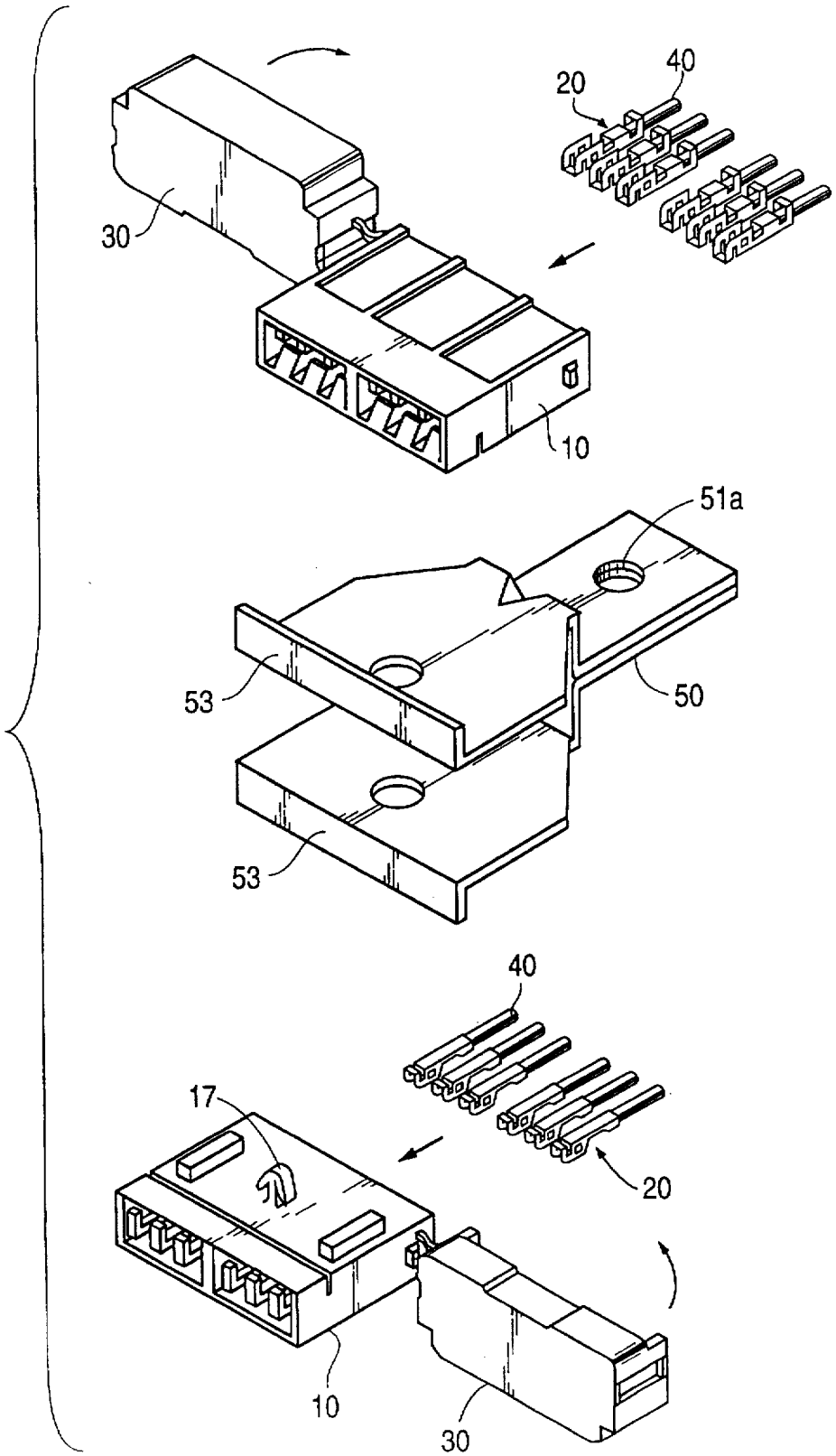
FIG. 11 is an exploded perspective view, from above, of a third form of connector constructed in accordance with the invention.

FIG. 11 shows a third form of connector whose connector plate 50 is formed with a pair of parallel base plates 52, each of which has a terminal member 53. The terminal members 53 project in opposite directions, whereby housings 10 can be attached from the upper face and the lower face of the connector plate 50.

Figure 12:
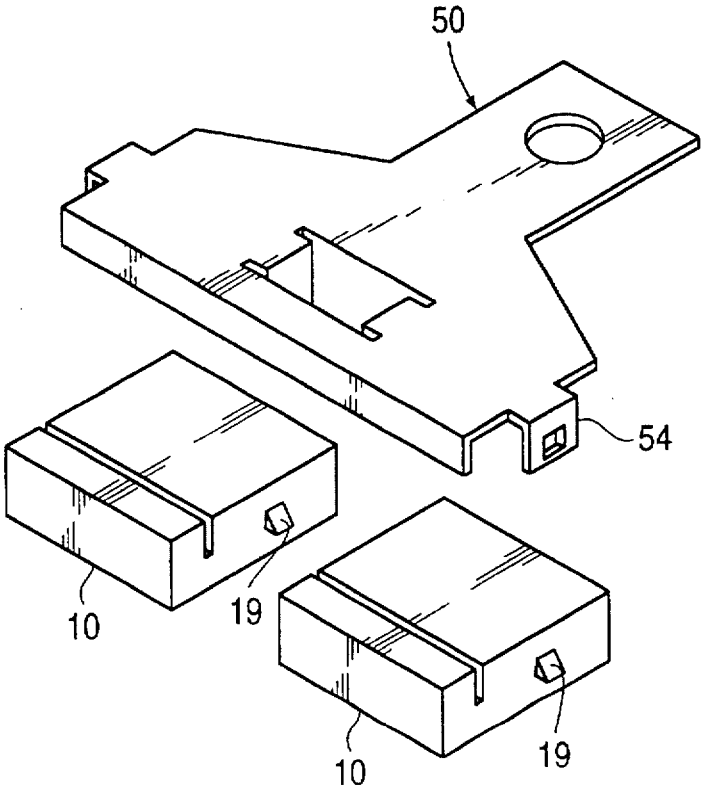
FIG. 12 is an exploded perspective view, from above, of a fourth form of connector constructed in accordance with the invention.
Figure 13:
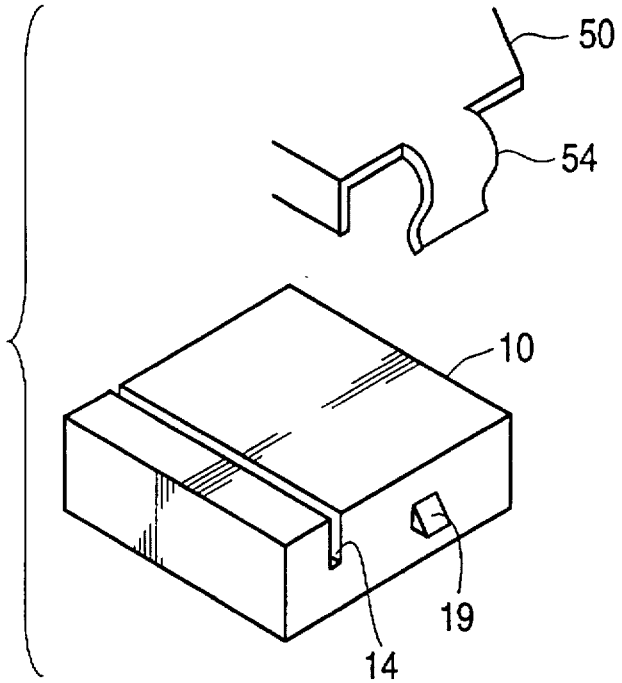
FIG. 13 is an enlarged perspective view of part of a modification of the fourth form of connector.
Figure 14:
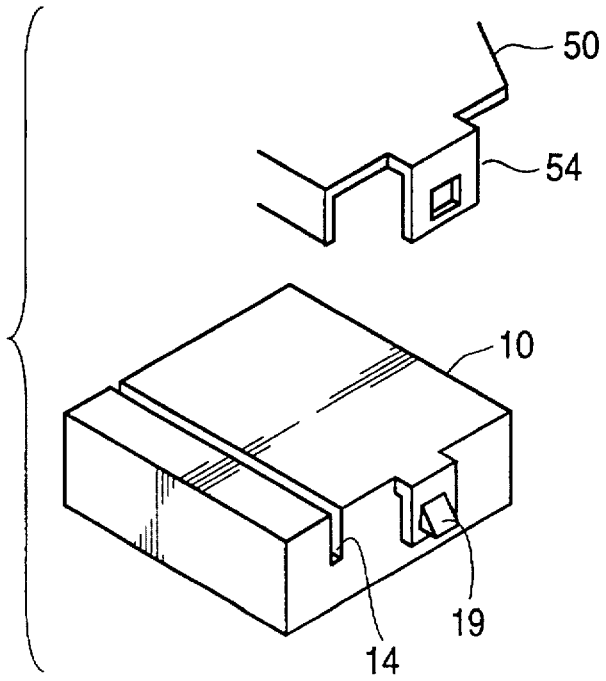
FIG. 14 is an enlarged perspective view of part of another modification of the fourth form of connector.
Figure 15:
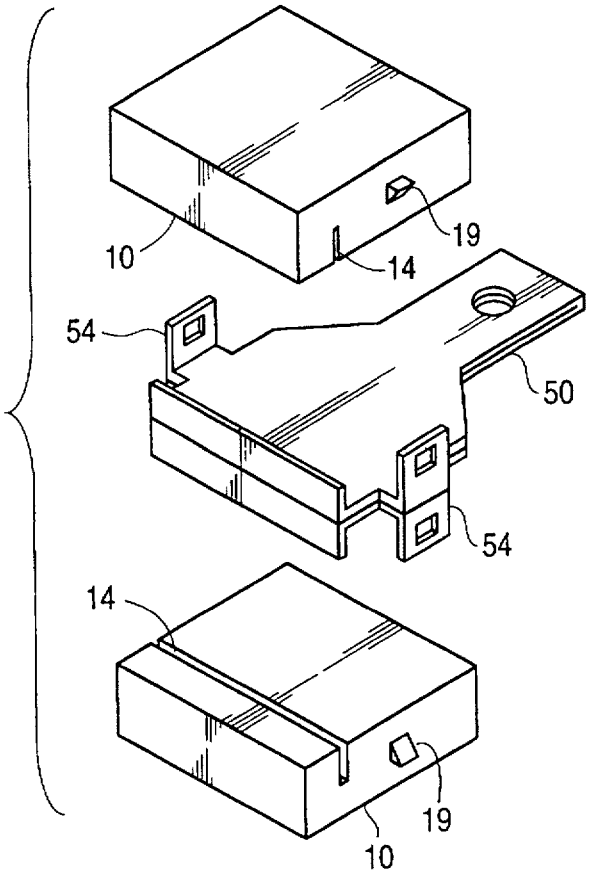
FIG. 15 is an exploded perspective view from above, of a fifth form of connector constructed in accordance with the invention.
Figure 16:
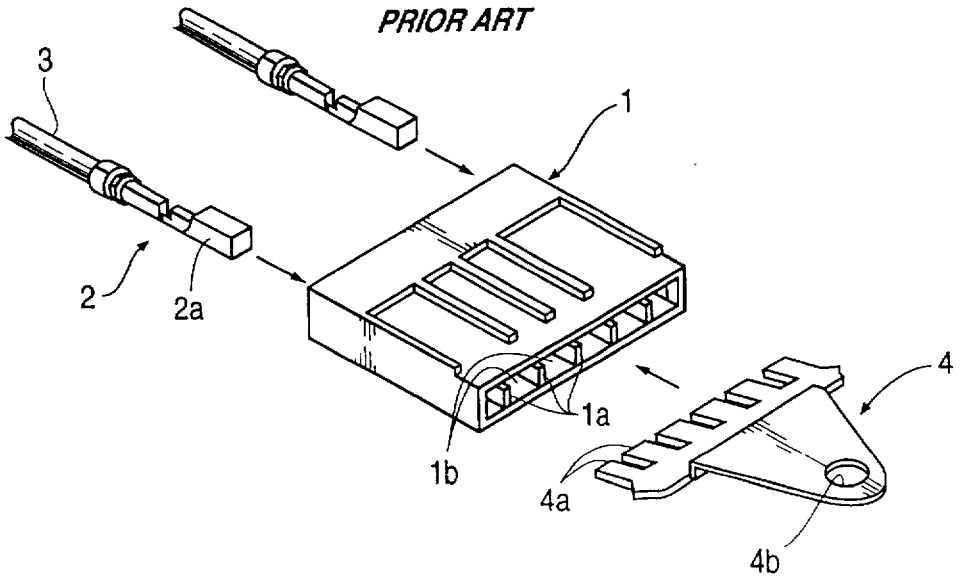
FIG. 16 PRIOR ART
FIG. 16 is an exploded perspective view of a conventional connector.

In this embodiment, a clamp 17 is provided on each of the housings 10, it being only, necessary that the conditions for achieving the specified position can be attained to fix the housings. The dimensions of the housings 10 are not, however, fixed. Where the dimensions of the housings 10 are fixed, projections 19 are provided on both the side surfaces of the housings 10 and (see FIGS. 12 to 15), and these are arranged to mate with apertured, downwardly-projecting arms 54 provided at the sides of the connector plate 50 and at The central region thereof. In use, each of the housings 10 is supported by two of the arms 54. FIGS. 13 and 14 show different forms of arms 54. As shown in FIG. 12, two housings 10 can be supported side-by-side. Alternatively, as shown in FIG. 15, two housings 10 can be supported face-to-face. As is clear, the centers are omitted from FIGS. 13–15 for clarity reasons.

As an alternative the double connector plate 50 of FIG. 11 can be provided as two separate plates fixed together by virtue of a bolt passing through the fixing aperture 51*a*. Furthermore, two planes or a folded double plate may have terminal members 53 facing each other if space requirements require. In this latter case the housings 10 are within the plates 50 but with a suitable clearance to permit initial fitting. Alternatively the open ended slot 14 permits a sliding attachment from one side. More than one connector plate may be attached by a single fixing bolt, the dimensions of the plate being arranged to maximise space utilisation.

We claim:

1. An electrical connector comprising a housing, a plurality of terminals mounted within the housing, and a connector plate for electrically connecting the terminals, the connector plate having an elongate plate member projecting therefrom, the housing being formed with an elongate slit for receiving the plate member, and with connection means for detachable engagement with complementary connection means formed on the connector plate, the connection means of the connector plate and the housing being engageable to fix the connector plate to the housing with the plate member extending into the slit and into electrical contact with each of the terminals, and the connector plate further having a connection member for connecting the connector plate to an earthed conductor, the connection member extending from the connector plate at an edge other than that from which the plate member projects.

2. A connector as claimed in claim 1, wherein the housing is formed with a plurality of parallel chambers, each of which receives a respective one of the terminals.

3. A connector as claimed in claim 2, wherein the slit extends across the housing substantially at right-angles to longitudinal axes of the chambers.

4. A connector as claimed in claim 2, wherein each terminal includes a terminal insertion member which is received in a respective one of the chambers.

5. A connector as claimed in claim 4, wherein each of the terminal insertion members is configured to receive a free edge portion of the plate member.

6. A connector as claimed in claim 5, wherein each of the terminal insertion members is formed with a slot for receiving the free edge portion of the plate member.

7. A connector as claimed in claim 6, wherein the slots in the insertion members are sized to receive the free edge portion of the plate member as a friction fit.

8. A connector as claimed in claim 5, wherein each of the terminal insertion members is formed with a bent over portion which is sized and shaped to receive the free edge portion of the plate member.

9. A connector as claimed in claim 1, wherein the plate member extends substantially at right-angles to the support member.

10. An electrical connector comprising two housings, each of which is provided with a plurality of terminals mounted therein, and a connector plate for electrically connecting the terminals of both housings, the connector plate having an elongate plate member means projecting therefrom, each of the housings being formed with an elongate slit for receiving the plate member means, and with connection means for detachable engagement with complementary connection means formed on the connector plate, the connection means of the connector plate the housings being engageable to fix the connector plate to the housings with the plate member means extending into the slits and into electrical contact with each of the terminals.

11. A connector as claimed in claim 10, wherein a single plate member constitutes the plate member means, and the arrangement is such that the two housings can be fixed side-by-side to the connector plate.

12. A connector as claimed in claim 10, wherein the connector plate is constituted by a pair of parallel base plates, each of which is formed with an elongate plate member projecting therefrom, the elongate plate members constituting the plate member means and projecting from their base plates substantially at right-angles in opposite directions, whereby the two housings can be fixed face-to-face to the two base plates.

* * * * *